US005540197A

United States Patent [19]

Golovatai-Schmidt et al.

[11] Patent Number: 5,540,197

[45] Date of Patent: Jul. 30, 1996

[54] DEVICE FOR ADJUSTING VALVE TIMING IN AN INTERNAL COMBUSTION ENGINE

[75] Inventors: Eduard Golovatai-Schmidt, Nuremberg; Martin Scheidt, Adelsdorf, both of Germany

[73] Assignee: INA Walzlager Schaeffler KG, Germany

[21] Appl. No.: 521,605

[22] Filed: Aug. 30, 1995

[30] Foreign Application Priority Data

Jan. 27, 1995 [DE] Germany ..... 195 02 496.6

[51] Int. Cl.[6] ..... F01L 1/344

[52] U.S. Cl. ..... 123/90.17; 123/90.31

[58] Field of Search ..... 123/90.15, 90.17, 123/90.31, 90.34

[56] References Cited

U.S. PATENT DOCUMENTS

| | | | |
|---|---|---|---|
| 5,012,773 | 5/1991 | Akasaka et al. | 123/90.17 |
| 5,150,671 | 9/1992 | Suga | 123/90.17 |
| 5,181,485 | 1/1993 | Hirose et al. | 123/90.17 |
| 5,209,193 | 5/1993 | Uchida et al. | 123/90.17 |
| 5,247,914 | 9/1993 | Imai et al. | 123/90.17 |
| 5,301,639 | 4/1994 | Satou | 123/90.17 |
| 5,305,718 | 4/1994 | Muller | 123/90.17 |

FOREIGN PATENT DOCUMENTS

| | | |
|---|---|---|
| 3316162 | 11/1983 | Germany . |
| 3415861 | 10/1985 | Germany . |
| 3929621 | 3/1991 | Germany . |
| 4218082 | 12/1993 | Germany . |
| 4218078 | 1/1994 | Germany . |

*Primary Examiner*—Weilun Lo
*Attorney, Agent, or Firm*—Bierman & Muserlian

[57] ABSTRACT

A device (3) for adjusting valve timing in an internal combustion engine, disposed on a drive pinion (4) within a control gear of at least one camshaft (2) mounted in a cylinder head (1), which drive pinion (4) is in driving relationship with said camshaft (2), said device (3) comprising an adjusting piston (5) axially displaceable by a hydraulic medium and having two oppositely oriented helical gear sections (6,9), and first of said two helical gear sections (6) cooperates with a corresponding gear (7) of a driving element (8) connected to the drive pinion (4), while second of said two helical gear sections (9) cooperates with a gear (10) of a driven element (11) connected to the camshaft (2), an end region of the camshaft (2) facing the device (3) being circumferentially surrounded by a connecting bracket (14) positioned, as seen in camshaft direction, behind the device (3) and comprising at least one pressure medium connection (19) for hydraulic medium supply to the adjusting piston (5) characterized in that the connecting bracket (14) is made in one piece with a valve housing (16) of a hydraulic control valve which permits an optional feeding of hydraulic medium into one of two pressure chambers (12,13) defined on each side of the adjusting piston (5).

10 Claims, 3 Drawing Sheets

DEVICE FOR ADJUSTING VALVE TIMING IN AN INTERNAL COMBUSTION ENGINE

STATE OF THE ART

Figure 1:
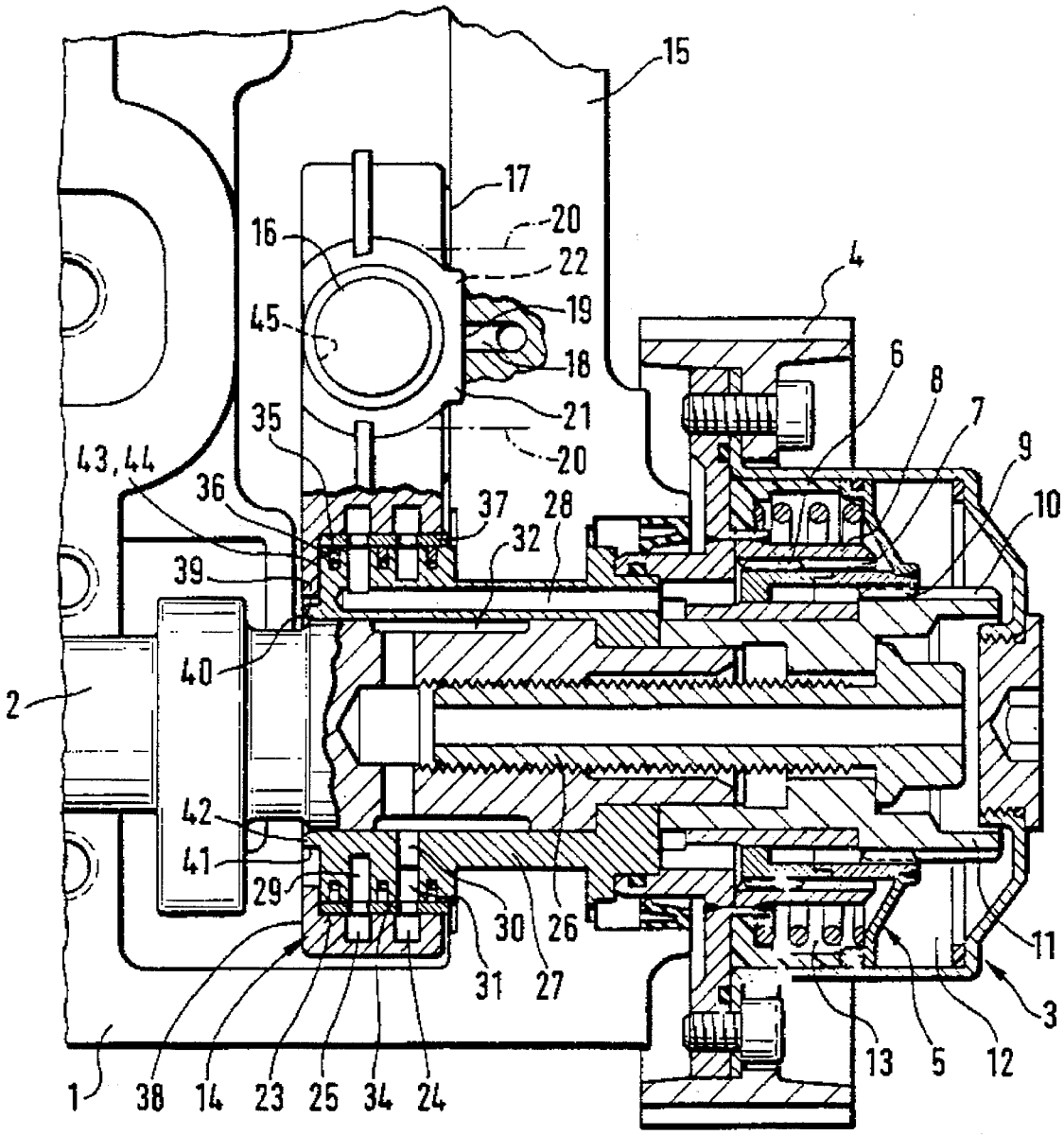

A device for adjusting valve timing in an internal combustion engine, disposed on a drive pinion within a control gear of at least one camshaft mounted in a cylinder head, which drive pinion is in driving relationship with said camshaft and is connected by a traction means to a crankshaft, said device comprising an adjusting piston axially displaceable by a hydraulic medium and having two oppositely oriented helical gear sections, and first of said two helical gear sections cooperates with a corresponding gear of a driving element connected to the drive pinion, while second of said two helical gear sections cooperates with a gear of a driven element connected to the camshaft, an end region of the camshaft facing the device being circumferentially surrounded by a connecting bracket positioned, as seen in camshaft direction, behind the device and comprising at least one pressure medium connection for hydraulic medium supply to the adjusting piston is known from the prior art. DE-A 42 18 082 shows, for example, in FIG. 1, a device comprising a connecting bracket which, as seen in camshaft direction, is fixed behind the device on an outer wall of the cylinder head. Hydraulic medium has to be fed into the pressure medium ducts referenced at 6, 7 from a separately disposed control valve. However, in certain installations, it is necessary to limit the axial extent of the entire device so as not to extend beyond the cylinder head.

OBJECTS OF THE INVENTION

It is an object of the invention to provide a device of the above type in which the aforesaid disadvantages are eliminated and a compact unit comprised of the control valve and connecting bracket is created by simple means and arranged to save design space.

This and other objects and advantages of the invention will become obvious from the following detailed description.

THE INVENTION

The device of the invention for adjusting valve timing in an internal combustion engine, disposed on a drive pinion (4) within a control gear of at least one camshaft (2) mounted in a cylinder head (1), which drive pinion (4) is in driving relationship with said camshaft (2), said device (3) comprising an adjusting piston (5) axially displaceable by a hydraulic medium and having two oppositely oriented helical gear sections (6,9), and first of said two helical gear sections (6) cooperates with a corresponding gear (7) of a driving element (8) connected to the drive pinion (4), while second of said two helical gear sections (9) cooperates with a gear (10) of a driven element (11) connected to the camshaft (2), an end region of the camshaft (2) facing the device (3) being circumferentially surrounded by a connecting bracket (14) positioned, as seen in camshaft direction, behind the device (3) and comprising at least one pressure medium connection (19) for hydraulic medium supply to the adjusting piston (5) is characterized in that the connecting bracket (14) is made in one piece with a valve housing (16) of a hydraulic control valve which permits an optional feeding of hydraulic medium into one of two pressure chambers (12,13) defined on each side of the adjusting piston (5).

This object is achieved by the fact that the connecting bracket is made in one piece with a valve housing of a hydraulic control valve which permits an optional feeding of hydraulic medium into one of two pressure chambers defined on each side of the adjusting piston. A further development of the invention also provides for the arrangement of this connecting bracket with the control valve within the cylinder head. This results in an extremely compact structural unit which does not unnecessarily increase the existing overall outer dimension of the cylinder head. At the same time, the mounting of the mentioned components is facilitated because no separate mounting operations and fixing devices are required for individual elements which otherwise have to be mounted separately. Further, this complex device can be subjected to functional tests in the dismounted state.

Further features of the invention describe advantageous arrangements of the connecting bracket and the valve housing fixed thereon. Depending on the available design space, the connecting bracket may likewise be disposed outside a gap defined as a rule between two camshafts.

A preferred simple means for oil supply to the connecting bracket is obtained by using the outer end wall of the cylinder head which end wall comprises bores for screwing means which engage into corresponding receiving bores in the connecting bracket. These measures are particularly conducive to mounting. However, the screwing means may also be arranged to extend from the connecting brackets. It is also conceivable to use any other fixing means known to a person skilled in the art for fixing the connecting bracket, the only important criterion being that a releasable connection is obtained. The end faces of the end wall and the connecting bracket facing each other are provided with sealing rings, not specified herein.

According to another embodiment of the invention, a positioning lug pointing towards the end wall is provided on the end face of the connecting bracket which positioning lug simplifies mounting and prevents the pre-assembled unit from turning out of place on the camshaft.

Preferred means for supplying oil from the connecting bracket to the device, properly speaking, for adjusting valve timing comprise slot-like openings which, on the one hand, guarantee the passage of a sufficiently Large quantity of oil and, on the other hand, permit a reduction of the overall axial dimension of the connecting bracket because the otherwise necessary wider oil outlets are not required.

The separate annular element described forms a part of the outer camshaft mounting support. The part of the annular element projecting out of the connecting bracket towards the device comprises an annular depression whose end faces serve to position the annular element on the outer end wall of the cylinder head. The oil transfer regions are sealed by steel sealing snap rings with extremely small end gaps.

The control valve is advantageously a 4/3 (4 ports, 3 operating positions) proportional solenoid valve inserted into the valve housing. In the "Off" position of this valve, no oil supply or discharge can take place. At the same time, the hydraulic design of the device in conjunction with the control valve is such that when hydraulic medium is discharged from one of the pressure chambers, the pressure drop is larger than the pressure drop when hydraulic medium is fed into the other of the two pressure chambers. This can be assured by the use of a slide, not specified, in the control valve which causes the supply connection to remain slightly open when the discharge connection is already closed. By these measures, it is guaranteed, that both pressure chambers are constantly filled with hydraulic medium and no air, which would impair their operation, can collect in the pressure chambers. At the same time, the travel of the adjusting piston is also facilitated.

The invention also provides for a simple positioning of the connecting bracket relative to the annular element. Since the bracket is preferably made of a "soft" aluminum material, the projecting lugs are abraded by the steel jacket of the annular element on initial operation, so that no unnecessary frictional losses are caused to the engine.

The invention is not limited only to the features recited in the claims. Combinations of individual features of the claims with one another and with disclosures made in the discussion of advantages and preferred examples of embodiments are both conceivable and intended.

REFERRING NOW TO THE DRAWINGS

Figure 2:
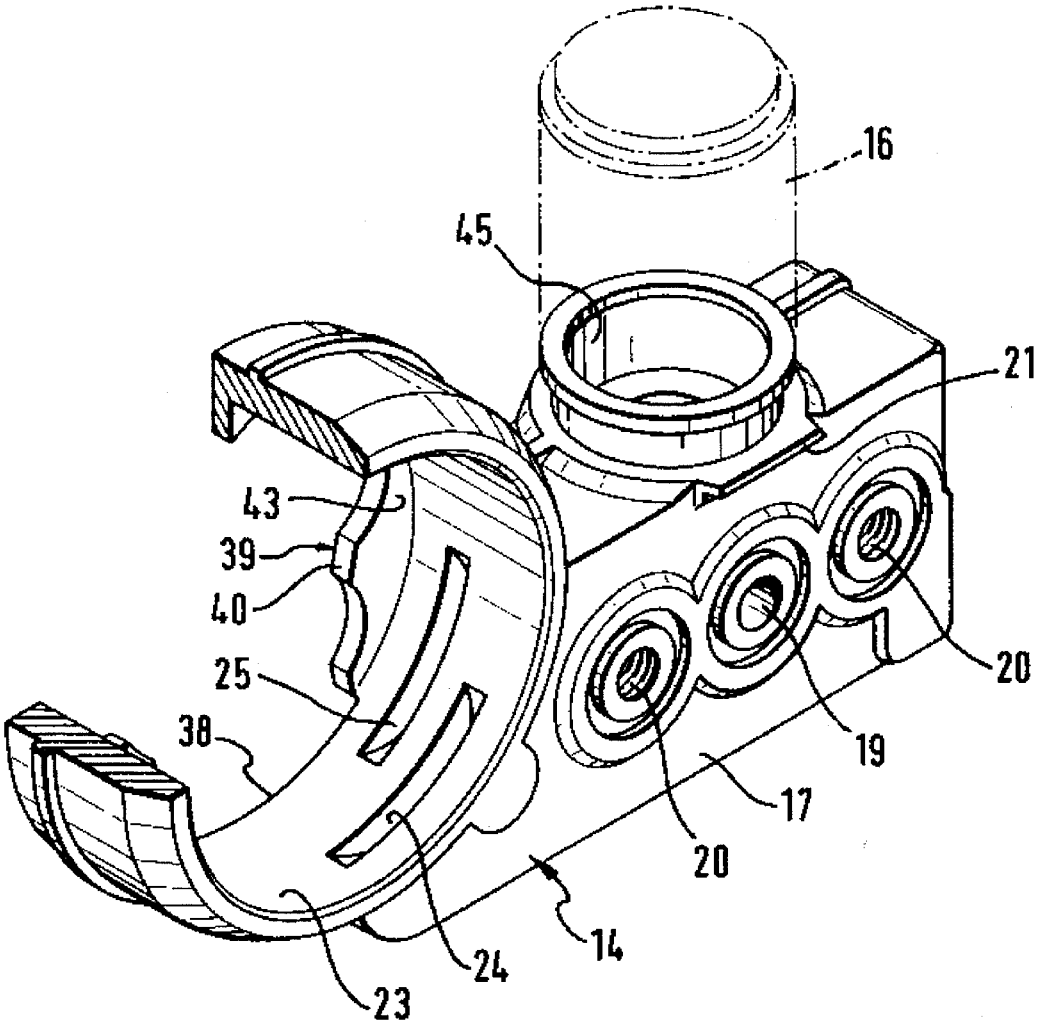
Figure 3B:
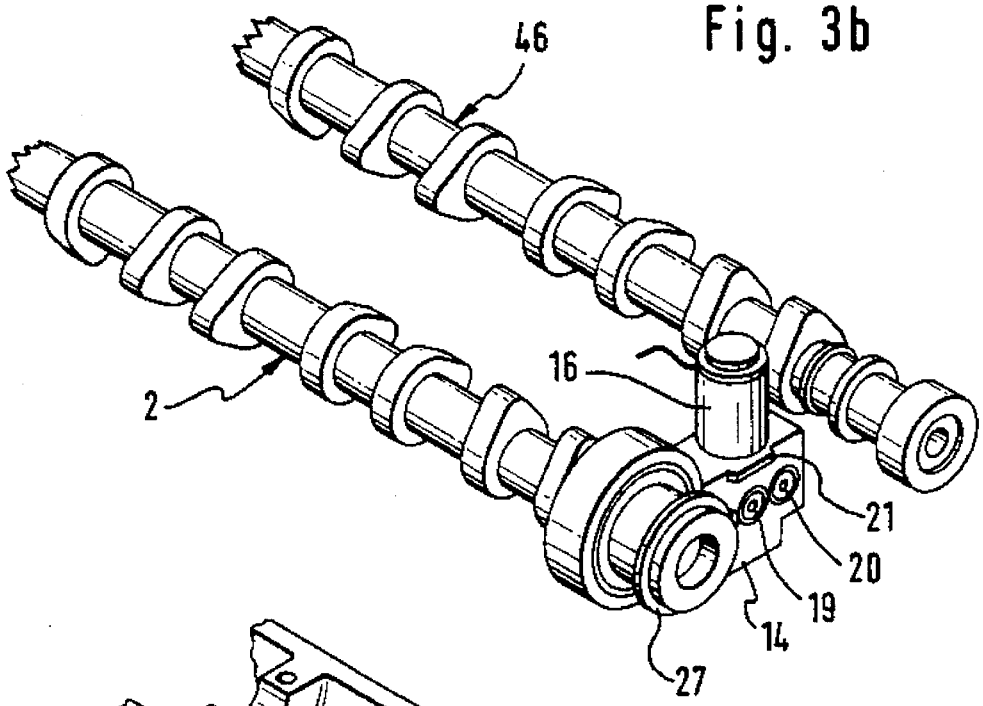
Figure 3A:
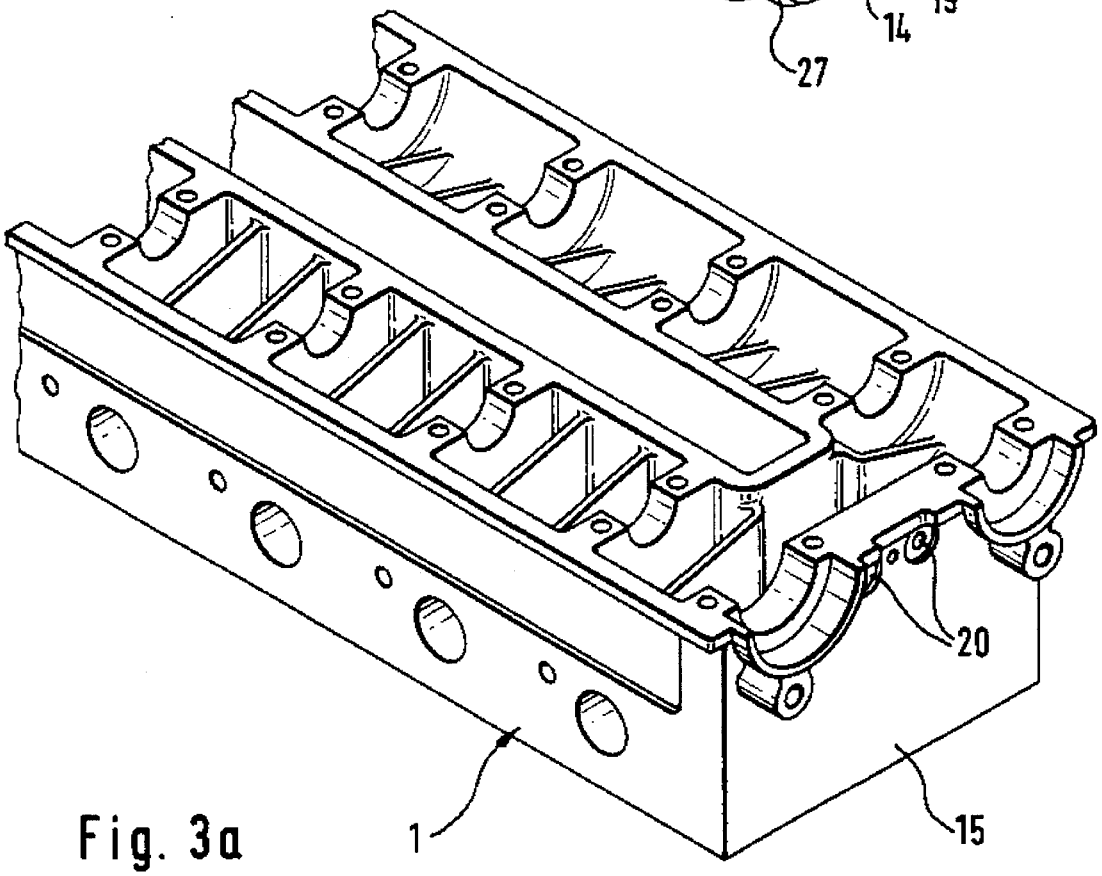

FIG. 1 is a top view of a cylinder head with a transverse cross-section of a device of the invention, FIG. 2 is a perspective view of the connecting bracket without an inserted control valve, FIGS. 3*a* and 3*b* are perspective views of a cylinder head and separately shown camshafts with a mounted connecting bracket.

FIG. 1 shows a cylinder head (1) in a top view. On the end of a camshaft (2) mounted in the cylinder head (1) is arranged a device (3), known per se, for adjusting valve timing. This device (3) is arranged in driving relationship between the camshaft (2) and a drive pinion (4) connected by a traction means, not shown, to a crankshaft. The device (3) comprises an adjusting piston (5) which is axially displaceable by a hydraulic medium. The adjusting piston (5) comprises an external helical gear section (6) which meshes with an internal helical gear section (7) of a driving element (8) connected to the drive pinion (4). The adjusting piston (5) further comprises an internal gear section (9) which meshes with an external gear section (10) of a driven element (11) connected to the camshaft (2). Pressure chambers (12,13) are defined on both sides of the adjusting piston (5). An optional supply of hydraulic medium to one of the pressure chambers (12 or 13), effects an axial displacement of the adjusting piston (5) and thereby a displacement, known per se, of the camshaft (2) relative to the drive pinion (4) by which it is driven.

The end region of the camshaft (2) facing the device (3) is encompassed by a connecting bracket (14). Advantageously, this connecting bracket (14) is arranged within the cylinder head (1) directly behind its end wall (15) facing the device (3). The connecting bracket (14) extends lengthwise towards a second camshaft (46) (see FIG. 3*b*). The connecting bracket (14) is made in one piece with a valve housing (16) for a 4/3 proportional solenoid valve. The valve housing (16) extends at right angles to a transverse central plane of the cylinder head (1).

An end face (17) of the connecting bracket (14) is fixed and sealed on the end wall (15). A supply of hydraulic medium to the control valve disposed in the valve housing (16) is assured by an oil outlet (18) out of the end wall (15) into an oil inlet (19) (see FIG. 2) of the connecting bracket (14). A simple fixing of the connecting bracket (14) on the end wall (15) is effected by screwing means (20), not shown. These screwing means (20) are arranged on both sides of the oil inlet (19) and extend from the end wall (15).

The connecting bracket (14) comprises a mounting aid in the form of a positioning lug (21) extending towards the end wall (15). This positioning lug (21) is seated on a support surface (22) of complementary shape provided on the end wall (15).

Due to the disposition of the entire valve housing including the connecting bracket (14) within the cylinder head (1), the adjusting device (3) does not unnecessarily occupy extra design space while, at the same time, a compact and easy-to-mount unit consisting of the connecting bracket (14) and the valve housing (16) is created. A number of functions are thus integrated in a single component (14,16). Supply of hydraulic medium from the connecting bracket (14) to the pressure chambers (12 and 13) is effected in the region of the bore (23) of the connecting bracket (14) which surrounds the camshaft (2) and comprises slot-like transfer openings (24, 25) arranged axially spaced from each other. Hydraulic medium from the first transfer opening (24) is fed via the camshaft (2) and a hollow fixing screw (26), not specified, into the first pressure chamber (12). The second transfer opening (25) supplies hydraulic medium to the second pressure chamber (13). For this purpose, a separate annular element (27) extends within the bore (23) of the connecting bracket (14) and projects axially out of the connecting bracket (14) towards the device (3). The annular element (27) is connected rotationally fast to the camshaft (2) and comprises at least one longitudinal bore (28) for the transfer of hydraulic medium into the second pressure chamber (13). Inside the connecting bracket (14), the longitudinal bore (28) comprises an annular groove (29) which communicates with the transfer opening (25). The annular element (27) further comprises at least one tap bore (30) which opens on one side into a further annular groove (31) of the annular element (27) and, on the other side, into a further annular groove (32) of the end region of the camshaft (2) from which hydraulic medium is fed into the first pressure chamber (12). A part of the periphery of the annular groove (31) is surrounded by the, in this case, crescent-shaped transfer opening (24).

For sealing this rotary transfer of hydraulic medium, radially outwards biased steel sealing rings (35) are inserted into circumferential grooves (36) in the outer peripheral surface (34) of the annular element (27) . To effect sealing, these steel sealing rings (35) cooperate with the bore (23) of the connecting bracket (14) or, as in the present case, directly with a separate ring (37).

Three circumferentially spaced lugs (39) for centering the connecting bracket (14) on the camshaft (2) extend radially inwards from an end (38) of the connecting bracket (14) facing away from the device (3). The inner peripheral surface (40) of these lugs (39) is in contact with an outer peripheral surface (41) of a shoulder (42) of the annular element (27), while inner surfaces (43) of the lugs (39) bear against an annular surface (44) of the shoulder (42).

FIG. 2 shows a bore (45) of the connecting bracket (14) in which the valve housing (16), shown in the top view of FIG. 1, is installed together with the control valve. A more detailed description of the device (3) comprising a connecting bracket (14) of the invention is not given herein because it is well-known in itself, particularly with regard to its structure and method of operation.

Finally, for a better understanding of the installed state, the connecting bracket (14) is shown in FIGS. 3*a* and 3*b* in three-dimensional views. The pre-assembled unit comprised of the connecting bracket (14), the annular element (27) and the camshaft (2) is mounted as a whole in the cylinder head (1). As described above, the connecting bracket (14) with the valve housing (16) is placed inside the cylinder head (1)

behind the outer end wall (15). As can likewise be seen in FIG. 3*b*, the control valve is already fitted into the valve housing (16). A discharge of hydraulic medium from the control valve is effected from an undersurface thereof, out of the connecting bracket (14) into the cylinder head. It is also conceivable to arrange such a device (3) comprising a connecting bracket (14) on both an inlet and an outlet camshaft. A use of the device of the invention is envisaged, for example, in valve actuating mechanisms driven by the camshaft with the help of a toothed belt. However, its use is not limited only to such belt drives. It is likewise conceivable to use the device in chain drives, in which case, the connecting bracket (14) is advantageously arranged on the end wall (15), but outside the cylinder head (1).

Various modifications of the device of the invention may be made without departing from the spirit or scope thereof and it is to be understood that the invention is intended to be limited only as defined in the appended claims.

What we claim is:

1. A device (3) for adjusting valve timing in an internal combustion engine, disposed on a drive pinion (4) within a control gear of at least one camshaft (2) mounted in a cylinder head (1), said drive pinion (4) is in a driving relationship with said camshaft (2), said device (3) comprising an adjusting piston (5) axially displaceable by a hydraulic medium and having two oppositely oriented helical gear sections (6, 9), said first of said two helical gear sections (6) cooperates with a corresponding gear (7) of a driving element (8) connected to the drive pinion (4), while second of said two helical gear sections (9) cooperates with a gear (10) of a driven element (11) connected to the camshaft (2), an end region of the camshaft (2) facing the device (3) being circumferentially surrounded by a connecting bracket (14) positioned, as seen in a camshaft direction, behind the device (3) and comprising at least one pressure medium connection (19) for hydraulic medium supply to the adjusting piston (5) and the connecting bracket (14) is made in one piece with a valve housing (16) of a hydraulic control valve attached to the bracket and which permits an optional feeding of hydraulic medium into one of two pressure chambers (12, 13) defined on each side of the adjusting piston (5), characterized in that the connecting bracket (14) is disposed within the cylinder head (1) immediately behind an end wall (15) thereof facing the device (3) and at least a part of an end face (17) of the connecting bracket (14) facing the end wall (15) is fixed and sealed on the end wall (15) and comprises an oil inlet (19) leading to the control valve in the valve housing (16), said oil inlet (19) communicates with an oil outlet (18) on the end wall (15) of the cylinder head (1).

2. A device of claim 1 for at least two overhead camshafts (2, 46), at least one of said two camshafts (2 or 46) is connected to the device (3), wherein the connecting bracket (14) extends towards the other of said two camshafts (46 or 2), and the valve housing (16) extends lengthwise approximately at right angles to a transverse central plane of the cylinder head (1).

3. A device of claim 2 wherein the connecting bracket (14) is connected to the end wall (15) by screwing means (20) projecting from the end wall (15), the screwing means (20) engages into receiving bores on an end face (17) of the connecting bracket (14) on both sides of an oil inlet (19).

4. A device of claim 2 wherein at least one of the end face (17) of the connecting bracket (14) facing the end wall (15), and the end wall (15) comprises at least one positioning lug (21) which cooperates with a support surface (22) of complementary shape on the other one of the end wall (15) and the end face (17).

5. A device of claim 1 wherein two axially spaced transfer openings (24, 25) for transfer of hydraulic medium from the connecting bracket (14) are arranged in a bore (23) thereof which surrounds the camshaft (2) and hydraulic medium can be fed from first of said two transfer openings (24) into a first pressure chamber (12) in front of the adjusting piston (5) and from a second of said two transfer openings (25) into a second pressure chamber (13) behind the adjusting piston, characterized in that the transfer openings (24, 25) are slot-shaped and extend over at least a part of a periphery of the bore (23).

6. A device of claim 5 wherein in a region of the connecting bracket (14), the camshaft (2) is directly surrounded by a separate annular element (27) which is non-rotatably connected thereto and comprises at least one longitudinal bore (28) for transfer of hydraulic medium into the second pressure chamber (13), the longitudinal bore (28) being connected, in a region of the bore (23) of the connecting bracket (14), to a first annular groove (29) which communicates with one of the transfer openings (25), the annular element (27) further comprises at least one tap bore (30) which is axially spaced from the first annular groove (29) and opens at one end into a second annular groove (31) of the annular element (27), which second annular groove (31) communicates with another of the transfer openings (24), while the tap bore (30) opens at a second end into an annular groove (32) of an end region of the camshaft (2) form where hydraulic medium can be transferred into the first pressure chamber (12).

7. A device of claim 6 wherein outwards biased steel sealing rings (35) which cooperate with the bore (23) of the connecting bracket (14) are arranged between and on both sides of annular grooves (29, 31) in an outer peripheral surface (34) of the annular element (27).

8. A device of claim 1 wherein the control valve is 4/3 proportional solenoid valve.

9. A device of claim 1 wherein the device (3) and the control valve are designed so that a pressure drop when hydraulic medium is discharged from one of the pressure chambers (12 or 13) is larger than a pressure drop when hydraulic medium is fed into the other of the pressure chambers (13 or 12).

10. A device of claim 6 wherein three circumferentially spaced lugs (39) extend radially inwards from an end (38) of the bore (23) of the connecting bracket (14) facing away from the device (3), and an inner peripheral surface (40) of the lugs (39) is in contact with an outer peripheral surface (41) of a shoulder (42) of the annular element (27), while inner surfaces (43) of the lugs (39) bear against an annular surface (44) of the shoulder (42).

* * * * *